US008108976B2

(12) United States Patent
Thorbole et al.

(10) Patent No.: US 8,108,976 B2
(45) Date of Patent: Feb. 7, 2012

(54) IMPACT RESISTANT SEAT BELT BUCKLE

(76) Inventors: Chandrashekhar K. Thorbole, Fayetteville, AR (US); David Renfroe, Fayetteville, AR (US)

( * ) Notice: Subject to any disclaimer, the term of this patent is extended or adjusted under 35 U.S.C. 154(b) by 720 days.

(21) Appl. No.: 11/820,596

(22) Filed: Jun. 19, 2007

(65) Prior Publication Data

US 2008/0313871 A1 Dec. 25, 2008

(51) Int. Cl.
*A44B 11/26* (2006.01)

(52) U.S. Cl. ..... 24/650

(58) Field of Classification Search ..... 24/633–643, 24/647, 650

See application file for complete search history.

(56) References Cited

U.S. PATENT DOCUMENTS

| | | | | |
|---|---|---|---|---|
| 3,639,951 | A * | 2/1972 | Inoue et al. | 24/650 |
| 4,368,563 | A * | 1/1983 | Lentz | 24/637 |
| 6,233,794 | B1 * | 5/2001 | Kohlndorfer et al. | 24/641 |
| 2006/0174459 | A1 * | 8/2006 | Bledsoe | 24/634 |

* cited by examiner

*Primary Examiner* — James Brittain

(74) *Attorney, Agent, or Firm* — Mayback & Hoffman, P.A.; Gregory L. Mayback; Rebecca A. Tie

(57) ABSTRACT

A buckle for a seat belt that resists unintentional unlatching when subjected to rapid acceleration or deceleration. The buckle assembly includes a female buckle and a removable male tongue plate. The female buckle includes a spring-loaded pawl that lockingly engages a slot in the removable tongue plate. The spring urges the pawl into locking engagement with the slot in the tongue plate. The present invention discloses a pawl-loading spring made from a material that resists elastic deformation when the buckle is subjected to a force perturbation such as the sudden acceleration or deceleration of the buckle that occurs during a crash. The spring material exhibits resistance to deformation when loaded at a high loading rate.

5 Claims, 2 Drawing Sheets

IMPACT RESISTANT SEAT BELT BUCKLE

BACKGROUND OF THE INVENTION

1. Field of the Invention

The present invention relates to a buckle for a seat belt that resists unlatching when subjected to rapid acceleration or deceleration.

2. Prior Art

In most juristictions, regulations require that motor vehicles be equipped with seat belts fitted directly or indirectly to the vehicle body at anchorage points in order to secure at least the driver to the driver's seat in the event of accidents. Conventional webbed seat belts include a buckle mechanism wherein one free end of the seat belt has a tongue plate affixed thereto and the opposing free end of the seat belt has a buckle affixed thereto. Examples of such prior art buckle assemblies are described in U.S. Pat. No. 3,851,360 to Minolla, and U.S. Pat. No. 3,969,795 to Stephenson. When the tongue plate is inserted into the main body of the buckle, a latch member housed within the buckle, which is conventionally a spring-loaded pawl, lockingly engages a hole in the tongue plate. The latched state (i.e., locked state) is maintained by a locking member, usually a spring, until the pawl is released from locking engagement with the hole in the tongue plate by manually depressing a release button housed on the buckle. When the locked state of the latch is cancelled by the aforesaid pressing operation of the release button, latch engagement is cancelled and the tongue plate is disengaged from the main body of the buckle.

The above-described type of seat belt buckle is constructed in such a manner that after the tongue plate is fully inserted into the buckle main body to a locked condition, the tongue plate should be reliably held in the locked state even if an impact (i.e., a high G event) is applied to the buckle. The locked condition is maintained because the latch (pawl) is constantly urged (pressed) by a spring member to lockingly engage the hole in the tongue plate. In an automobile, the release button, which is operable for releasing the buckle assembly from the locked state, is structured so as to be able to be pressed by a relatively small force sufficient to overcome the urging force of the spring member and enable disengagement of the tongue plate from the buckle. In aircraft, stronger springs are employed and the release button is activated by a lever that provides the user with the mechanical advantage required to overcome the force of the spring member.

It is important that automobile seat belt buckles do not open unintentionally in the event that a "high G" event such as a crash occurs. When the buckle to which the tongue plate is locked is instantaneously pulled, a condition referred to as "reverse G" occurs in the buckle. In a conventional buckle, even when the release button is not pressed, there is a risk that the tongue plate will disengage from the buckle by the latch being unintentionally cancelled such as may occur when the buckle main body is forcibly and rapidly accelerated or decelerated. When such reverse G conditions occur, an inertial force corresponding to the total mass of the release button and locking mechanism housed within the case of the buckle main body, acts on the release button, locking mechanism and the like in a direction such that the lock state is released. As a result, the lock state may be forcibly cancelled and the tongue plate may release from the buckle main body. In order to prevent the tongue plate from releasing from the main buckle body in the conventional seat belt buckle, the spring force of the spring, which constantly urges the latch to a locked position, may be increased. However, as the spring becomes larger in size, the release force that must be applied to the release button for releasing the locking state of the latch against spring force of the spring, is increased.

Several attempts to address the problem of unintentional release of seat belt buckles during a high G event have been disclosed. Knox, in U.S. Pat. No. 6,918,458, discloses a load management system and method for controlling the activation sequence and times of activation of motor vehicle occupant restraints when a high g event, such as a crash, occurs. The system includes a microprocessor that processes inputs from a number of devices including a seat weight sensor, an occupant spatial position detector, a buckle status detector and a belt sensor. The microprocessor is driven by a load management procedure that includes a high G event routine that controls the activation sequence of restraints so that the automatic locking restraint is first activated, followed by the pre-tensioner and then by the air bag. The load management procedure also includes an enable/disable procedure that controls the enabling and disabling of the restraints according to a number of variables including occupant weight, seat buckle status and belt extension status.

Katsuyama et al., in U.S. Pat. No. 6,588,077, disclose a seat belt buckle which is operable for preventing the ejection of a tongue plate from a buckle main body under reverse G conditions without increasing release force for releasing a lock state. In accordance with the teaching of Katsuyama et al., the seat belt buckle comprises a latch including a latch swinging end portion, a lock member including a lock swinging end portion, which is made to swing between a lock position, at which at the time of latching, the lock swinging end portion swings on the latch swinging end portion and (sic) engage to stop the latch swinging end portion in a state of pressing the latch swinging end portion toward engagement holes of a tongue plate and a base while pressing the same in a tongue plate insertion direction, thereby locking the latching, and a lock release position, a lock operation end portion for releasing the locking and a weight portion formed at the side of the lock swinging end portion.

In view of the complexity of the above-referenced prior art solutions, there remains a continuing need for a seat belt buckle that has simple construction and resists disengagement when subjected to a high G event. A simple solution to the problem of unintentional release of a seat belt during crash impact has been disclosed by Renzi, Sr. et al. in U.S. Pat. No. 5,416,957. Renzi, Sr. et al. disclose an impact cushion for a seat belt latch comprising a sleeve of a latex rubber material sized to slide lengthwise over a female seat belt connector with an interference fit. The front side of the sleeve has an opening in a position corresponding to the release button of the connector, so that the button is not obstructed. The rear of the cushion is provided with a rigid metal plate; segmented ribs running lengthwise along the inside upper and lower surfaces of the sleeve hold the rear of the seat belt a short distance away from the plate. The cushion is intended to reduce the incidence of seat belt buckle failure during accidents, resulting from impact directly to the buckle. The impact cushion is not effective for preventing the unintentional release of the tongue blade from the buckle unless the impact is delivered directly to the buckle. There remains a need for a seat belt buckle that resists unintentional release of the tongue blade when the buckle is subjected to a high G event even when the buckle is not directly impacted.

SUMMARY

The present invention is directed to an improvement in a seat belt buckle that substantially obviates one or more of the limitations of the related art. To achieve these and other advantages, and in accordance with the purpose of the invention as embodied and broadly described herein, the invention is an improvement in a prior art seat belt buckle assembly. The prior art buckle assembly comprises two principle parts: a (female) main body having an open receiving end; and a (male) tongue plate having a slot therein. A portion of the tongue plate bearing the slot is insertable into the open receiving end of the main body. The main body includes a spring-loaded pawl that lockingly engages the slot when the tongue plate is inserted into the open receiving end of the main body of the buckle and fully advanced thereinto. The improvements comprise a spring that resist elastic deformation when subjected to short duration (~1-5 millisecond) acceleration or deceleration and a release button.

In one embodiment, the seat belt buckle assembly comprises a female buckle and a removable male tongue blade. The male tongue blade is a substantially planar member having a slot therein. The female buckle comprises a casing with an upper surface, a lower surface, a closed end, and an open end adapted to receive a portion of the tongue blade. It also has a hole in the upper surface opposite the open end. The female buckle houses a spring-loaded pawl assembly. The spring-loaded pawl assembly has a substantially V-shaped cross section comprising a pivot point, an upper arm and a lower arm. The pivot point is situated near the open end of the casing. The upper arm accommodates a pawl and a release button. The pawl is dimensioned to fit within the slot in the tongue plate. The release button is spatially offset from the pawl, opposite the pivot point, dimensioned to fit within the hole of the casing and to protrude above its upper surface. The lower arm accommodates a spring disposed between the casing and the upper arm. The spring is elastically deformable and operable for simultaneously urging the pawl into the slot and the release button into the hole. It is minimally deformable when subjected to a change in force applied to the pawl when the force has a duration of 1-5 milliseconds.

In the second embodiment, the female buckle further comprises a damping device disposed between the pawl and the casing. The damping device, which may be a compressible hydraulic or pneumatic member, is operable for resisting elastic deformation of the spring, and translational motion of the pawl, when the pawl is subjected to a change in force having a duration of between 1-5 milliseconds. The damping device only permits substantial translational motion of the pawl (i.e., motion sufficient to disengage the pawl from the slot) when the pawl is subjected to a change in force having a duration greater than 5 milliseconds such as occurs during intentional manual depression of the pawl to release the seat belt buckle.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION OF THE PREFERRED EMBODIMENTS

It is an object of the invention to provide a seat belt buckle that resists unintentional opening (i.e., disengagement of a spring-loaded pawl from a slot within a separable tongue blade) when the buckle experiences a high-G event such as a crash. Accordingly, the movement of the pawl should be unresponsive to a force impulse having a duration of ~1-5 milliseconds, but be responsive to a uniform force applied to overcome the force of the spring over a longer period of time such as 1 second. The principle of operation of the invention can be understood by considering the response of theoretical load-damping devices shown in FIGS. 1-2 when a force F (FIGS. 3 and 4) is applied to a pawl.

Figure 1:
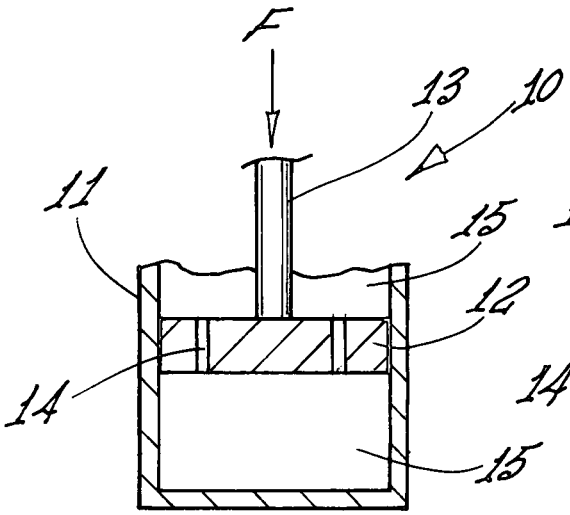
FIG. 1 is a schematic view of a load-damping mechanism comprising a piston slidably mounted in the bore of a cylinder wherein a compressible fluid such as air, housed within the cylinder bore, is displaced during vertical motion of the piston.

Turning now to FIG. 1, a relatively ineffective spring-damping mechanism is schematically illustrated in longitudinal cross-sectional view at numeral 10. The mechanism 10 comprises a cylinder 11 having a piston 12 slidingly disposed therewithin. The piston 12 further includes a push-rod 13 operable for moving the piston 12 within the cylinder 11 when a force F is applied thereto. The cylinder 11 is sealed and contains a compressible fluid 15 such as air. Holes 14 in the piston 12 enable the passage of air from one side of the piston to the other side when a force F is applied to the push-rod and the piston is reciprocally moved within the cylinder. When a high-G event such as a crash occurs, the force F on the push-rod is a brief (~1-5 msec) but intense pulse having the form illustrated in FIG. 3. When such an intense pulse F is transferred to the piston 12 by the push-rod 13 in the direction shown by the arrow, the piston will move downwardly thereby both compressing and displacing the air in the lower compartment. The rate at which the piston moves will depend on the size of the holes 14, the temperature of the air 15 and the viscosity of the air. Thus, only a portion of the energy imparted to the piston at impact results in translational motion of the piston 12. Some of the energy is used to heat the air either by compression or by friction due to flow of the air 15 through the holes 14.

Figure 2:
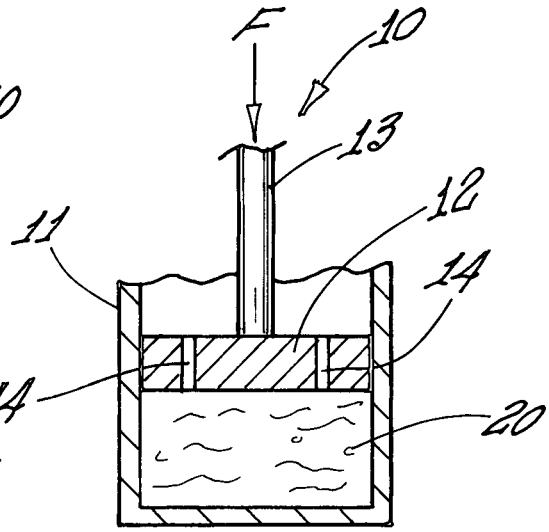
FIG. 2 is a schematic view of a load-damping mechanism similar to the mechanism shown in FIG. 1 but wherein a viscous noncompressible fluid such as oil, housed within the cylinder bore, is displaced during vertical motion of the piston.
Figure 3:
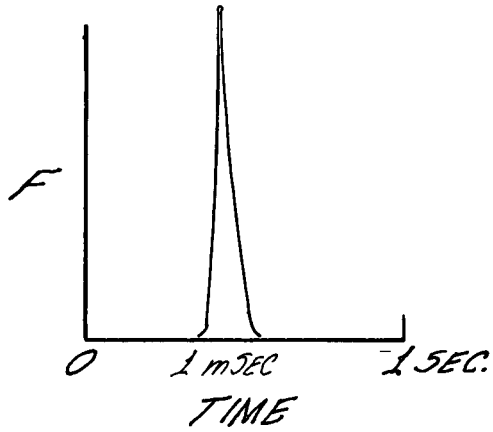
FIG. 3 is a graphic representation illustrating a force pulse delivered to a pawl within a seat belt buckle when the buckle is rapidly accelerated such as occurs during a crash.
Figure 4:
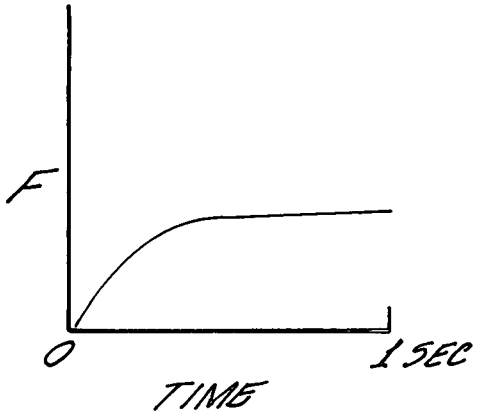
FIG. 4 is a graphic representation illustrating the force applied to a spring-loaded pawl within a seat belt buckle when the release button on the buckle is manually depressed to disengage the pawl from the slot in the tongue blade.

With reference now to FIG. 2, if the air in mechanism 10 is replaced by a more viscous, noncompressible fluid such as oil 20, the rate of displacement (i.e., translational motion) of the piston in response to the same applied force F, applied over a short time period such as 1-5 msec, will be decreased due to the noncompressibility of the fluid 20 and the increased frictional heat loss that occurs when the more viscous oil 20 flows through the holes 14. The translational motion of the piston is limited by the rate of flow of the oil through the holes. If a much lower force F, such as shown in FIG. 4, is applied to the push-rod 13 over a longer period of time sufficient to permit the flow of the oil through the holes with minimal resistance, the piston will move freely. Thus, the piston 12 in device 10 moves relatively freely when subjected Lo a force pulse (FIG. 3) and the cylinder 11 contains a compressible fluid such as air when compared to the translational motion of the piston when the cylinder contains a noncompressible, viscous fluid. In the device 10 of FIG. 2, much of the energy applied to the push-rod when a pulse of force F is applied thereto is converted to heat loss, and only a small portion of the applied energy is translational. The translational motion of the piston in the device 10 of FIG. 2 is minimally responsive to an impulsive force applied thereto, but responsive to a smaller steady force such as shown in FIG. 4.

Figure 5:
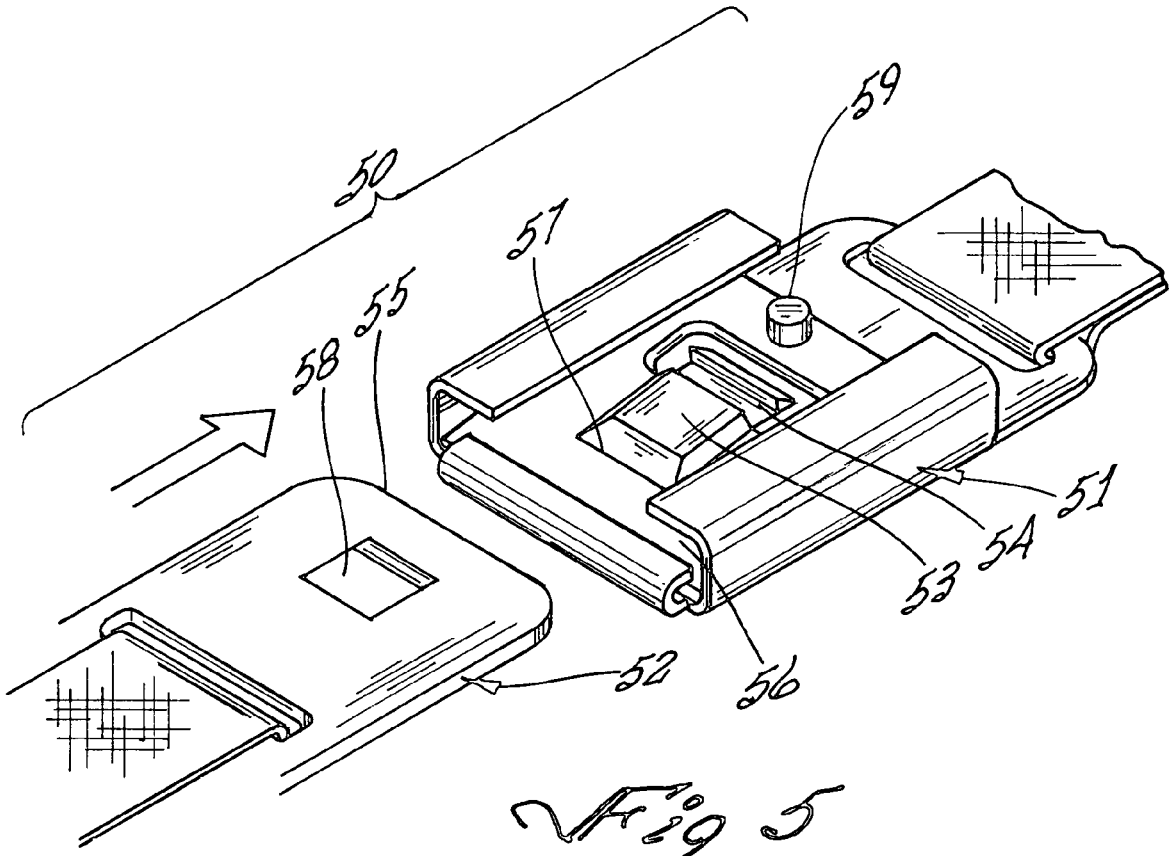
FIG. 5 is a perspective view of an exemplar of a seat belt buckle assembly illustrating the structural and functional relationship between a spring-loaded pawl housed within a first portion of the buckle assembly and a slot on a second portion (i.e., tongue blade) of the buckle assembly prior to the insertion of the second part into the first part.

With reference now to FIG. 5, a seat belt buckle assembly 50 is illustrated in perspective view. The buckle assembly 50 comprises a female buckle 51 and a male tongue plate 52. The buckle 51 includes a pawl 53 supported by a spring 54. When the leading end 55 of the tongue plate 52 is inserted into an open receiving end 56 of the buckle 51 and advanced thereinto, the tongue blade rides over an inclined end 57 of the pawl 53, depressing the pawl 53 and compressing the spring 54. Continued advancement of the tongue plate into the buckle brings a slot 58 into alignment with the pawl 53 and the spring 54 urges the pawl 53 upwardly into the slot 58 thereby completing locking engagement between the buckle 51 and the tongue plate 52. The locking engagement is released when the spring 54 is compressed by the application of manual pressure to the seat belt release button 59.

Figure 6:
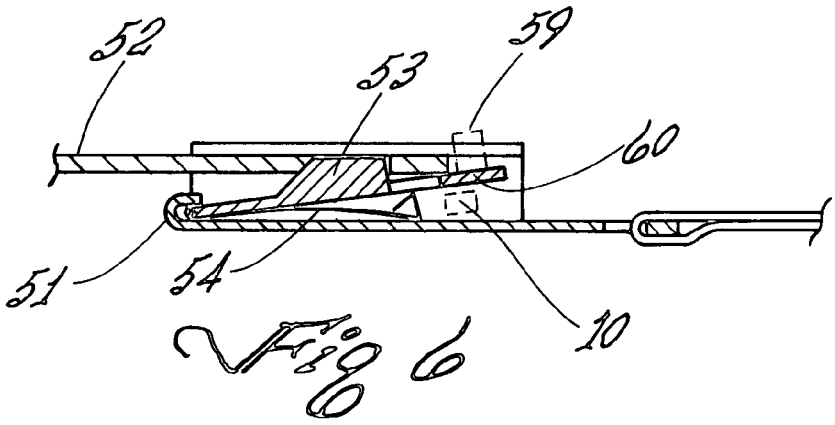
FIG. 6 is a simplified cross-sectional side view of a seat belt buckle assembly in accordance with FIG. 5 showing locking engagement of the second and first parts of the buckle after the insertion of the second part of the buckle into the first part of the buckle.

FIG. 6 is a simplified cross-sectional side view of the seat belt buckle assembly in accordance with FIG. 5 showing locking engagement of the tongue plate 52 and the buckle 51 after the insertion of the tongue plate into the buckle. The subassembly comprising the pawl 53 and the release button 59 has a mass and inertia. When a high-G event (crash) occurs, and the momentum of the subassembly is abruptly changed, the momentum of the subassembly may compress the spring 54 and cause the pawl 53 to disengage from the slot in the tongue plate and release. If a load-damping device 10 is interposed between the pawl mounting member 60 and the buckle 51, the damping mechanism 10 will dissipate much of the translational energy of the subassembly and prevent such unintentional disengagement. Other load-damping mechanisms such as an elastically deformable silicone elastomeric body disposed between the pawl mounting member 60 and the buckle 51 will have a similar effect. More preferably, the spring 54 is comprised of a material that converts the translational energy of the subassembly (due to rapid acceleration or deceleration thereof) into another form of energy when the subassembly experiences rapid loading. A spring comprised of such a material will resist compression only in response to impulsive loading when the rate of change in the load is abrupt (i.e., on the order of milliseconds), and readily compress in response to gradual loading (i.e., on the order of a second). Suitable spring materials that exhibit such a load-damping property when subjected to an impulsive load include carbon and glass fibers.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What we claim is:

1. A seat belt buckle assembly operable for resisting unintentional opening when subjected to rapid acceleration or deceleration comprising:

a female buckle and a removable male tongue plate, said male tongue plate being a substantially planar member having a slot therein, said female buckle having a casing with an upper surface, a lower surface, a closed end, and an open end adapted to receive a portion of said tongue blade, a hole in said upper surface opposite said open end, and a spring loaded pawl assembly housed within, wherein said spring-loaded pawl assembly has a substantially V-shaped cross section comprising a pivot point, an upper arm and a lower arm, said pivot point being situated near said open end of said casing, wherein said upper arm accommodates a pawl and a release button, said pawl being dimensioned to fit within said slot in said tongue plate, said release button being spatially offset from said pawl, opposite said pivot point, dimensioned to fit within said hole and protrude above said upper surface of said casing, wherein said lower arm accommodates a spring disposed between said casing and said upper arm, said spring being elastically deformable and operable for simultaneously urging said pawl into said slot and said release button into said hole, said female buckle further comprising a damping device disposed between said pawl and said casing, said damping device being operable for resisting elastic deformation of said spring and translational motion of said pawl when said pawl is subjected to a change in force having a duration of 1-5 milliseconds.

2. A seat belt buckle assembly in accordance with claim 1 wherein said damping device permits translational motion of said pawl when said pawl is subjected to a change in force having a duration greater than 5 milliseconds.

3. A seat belt buckle assembly operable for resisting unintentional opening when subjected to rapid acceleration or deceleration comprising:

a female buckle and a removable male tongue plate, said male tongue plate being a substantially planar member having a slot therein, said female buckle having a casing with an upper surface, a lower surface, a closed end, and an open end adapted to receive a portion of said tongue blade, a hole in said upper surface opposite said open end, and a spring loaded pawl assembly housed within, wherein said spring-loaded pawl assembly has a substantially V-shaped cross section comprising a pivot point, an upper arm and a lower arm, said pivot point being situated near said open end of said casing, wherein said upper arm accommodates a pawl and a release button, said pawl being dimensioned to fit within said slot in said tongue plate, said release button being spatially offset from said pawl, opposite said pivot point, dimensioned to fit within said hole and protrude above said upper surface of said casing, wherein said lower arm accommodates a spring disposed between said casing and said upper arm, said spring being elastically deformable and operable for simultaneously urging said pawl into said slot and said release button into said hole, said female buckle further comprising a damping device disposed between said pawl and said casing, said damping device being operable for resisting elastic deformation of said spring and translational motion of said pawl when said pawl is subjected to a change in force having a duration of 1-5 milliseconds, said spring being minimally deformable when subjected to a change in force applied to said pawl wherein said force has a duration of 1-5 milliseconds.

4. A seat belt buckle assembly in accordance with claim 3 wherein said spring comprises carbon fibers.

5. A seat belt buckle assembly in accordance with claim 3 wherein said spring comprises glass fibers.

* * * * *